United States Patent [19]

Tax

[11] 4,045,866

[45] Sept. 6, 1977

[54] CRANE AND METHOD OF BUILDING THE SAME

[76] Inventor: Hans Tax, Potsdamer Str. 3, Munich 40, Germany, 8000

[21] Appl. No.: 722,427

[22] Filed: Sept. 13, 1976

[30] Foreign Application Priority Data

Sept. 26, 1975 Germany ..... 2543041

[51] Int. Cl.[2] ..... H01R 43/00

[52] U.S. Cl. ..... 29/628; 29/431; 212/17

[58] Field of Search ..... 52/741, 745; 29/428, 29/434, 469, 431, 628; 212/1, 15, 17, 10

[56] References Cited

U.S. PATENT DOCUMENTS

| | | | |
|---|---|---|---|
| 2,676,388 | 4/1954 | Faure et al. | 29/431 |
| 2,958,940 | 11/1960 | Murphy | 29/431 |
| 3,372,475 | 3/1968 | Vickery, Jr. | 29/628 |
| 3,888,356 | 6/1975 | Redelfs | 212/15 |
| 3,909,935 | 10/1975 | Aldridge et al. | 29/628 |
| 3,945,107 | 3/1976 | Houck | 29/431 |
| 3,945,503 | 3/1976 | Cooper | 212/11 |

*Primary Examiner*—Lawrence J. Oresky
*Attorney, Agent, or Firm*—Hans Berman

[57] ABSTRACT

In building a crane, the electrically actuated winches for raising and lowering the boom for moving a trolley along the boom, and for operating a hoist on the trolley are fixedly mounted in a standard transport container at a construction site remote from the assembly site for the crane. The power supply system for the winches, including a step-down transformer and switch gear, is similarly mounted in a second container remotely from the assembly site. The two containers and their contents are lifted to the top of the erected crane tower and permanently fastened there. The winch motors are connected to the switch gear by a plug-in, multi-conductor cable, and the winches are connected with the boom, the trolley, and the hoist by steel cables or other tension elements. Labor for installing the winches and the associated electrical system is reduced and damage to the relatively sensitive machinery during assembly with other crane elements is avoided.

6 Claims, 4 Drawing Figures

CRANE AND METHOD OF BUILDING THE SAME

This invention relates to a crane operated by means of electrically actuated winches, and to a method of building such a crane.

It was common practice heretofore in building a heavyduty crane to erect a supporting tower, to pivotally fasten a boom to the tower, to install a trolley for movement longitudinally of the boom, individually to install the winches needed for operating the boom, the trolley, and a hoist depending from the trolley, and sequentially to install the electrical power supply system for the winches, typically a step-down transformer and switch gear remotely controlled by the crane operator from his cab on the trolley. Erection of the principal load-bearing, structural elements of the crane had to be completed before the installation of the winches and of the electrical equipment could begin, and it was relatively costly and time-consuming to install the operating machinery at the top of the crane tower. Damage to the machinery during transportation to the top of the tower and during installation could not always be prevented.

It has now been found that the installation of the winches and of the associated power supply system can be simplified, and that the risk of damage to the machinery can be reduced sharply by permanently mounting the winches in one standardized transportion container and the electrical equipment in another container at the plants of the respective manufacturers, to transport the containers and their contents to the assembly site for the crane, to hoist the containers to the top of the crane tower, and there to fasten them, thereby installing the winches and their electrical power supply system in their respective housings in two relatively simple and very short steps. Cables or other tension elements may then be arranged between the winches and the boom, trolley, and hoist operated by the winches, and a single, multiconductor cable fastened to one container at the manufacturing plant may be plugged into an outlet on the other container to establish the necessary conductive connection between the winch motors and the power supply system.

It is one of the important advantages of this method that the several component parts of the crane may be built at different places independently from each other except for final steps as simple as the installation of steel cables or the plugging-in of an electrical connection. The winch unit and the electrical unit may be transported to the assembly site at any convenient time and are protected there against accidental damage until the basic crane structure is ready to accept them. There is no labor-consuming waiting time, and the effort required for installing the several individual machines in their containers in the manufacturing plant and for mounting the containers on the crane tower is significantly smaller than that required in the conventional building method.

It was customary heretofore to install the winches and associated electrical equipment in a common shed high on the crane. By separating the mechanical and electrical elements of the drive system, the load of the heavy equipment can be distributed more advantageously, and better use can be made of the available space.

If more convenient, not all winches need be mounted in a single container, and not the entire electrical equipment need be housed in the second container. The step-down transformers employed for reducing the high voltage of a power line to the operating voltage of the winch motors may be so heavy that it is advantageous further to subdivide the power supply system between two containers respectively containing the transformer and the remotely controlled switch gear which directs the output current of the transformer to the individual winch motors. The winch for the load lifting cable of the hoist on the trolley is sometimes installed on the trolley itself, and the winch for moving the trolley along the boom may also be mounted there. However, two winches are normally needed for raising and lowering the boom, and at least some of the advantages of the invention are obtained if at least these two winches come to the crane assembly site permanently installed in their transportation container ready to be mounted on the crane tower together with their container which provides a permanent housing for them.

Doors and windows are preferably provided in the containers before they are transported to the crane assembly site so as to permit observation and servicing of the machinery in each container after mounting on the crane.

Large cranes are often assembled in places where equipment for handling standardized, large containers is available, as in harbors, railroad and truck terminals. It is advantageous to install the winches and the associated electrical equipment in containers meeting the dimensional standards established by the ISO (International Standardization Organization), and equipped with corner fittings meeting such standards so that they may be lifted to their installation site on the crane tower by means of machinery readily available at the site and equipped with engaging fittings matching the corner fittings on the containers.

Other features, additional objects, and many of the attendant advantages of this invention will readily be appreciated from the following detailed description of a crane built according to the method of the invention when considered in connection with the appended drawing in which.

Figure 1:
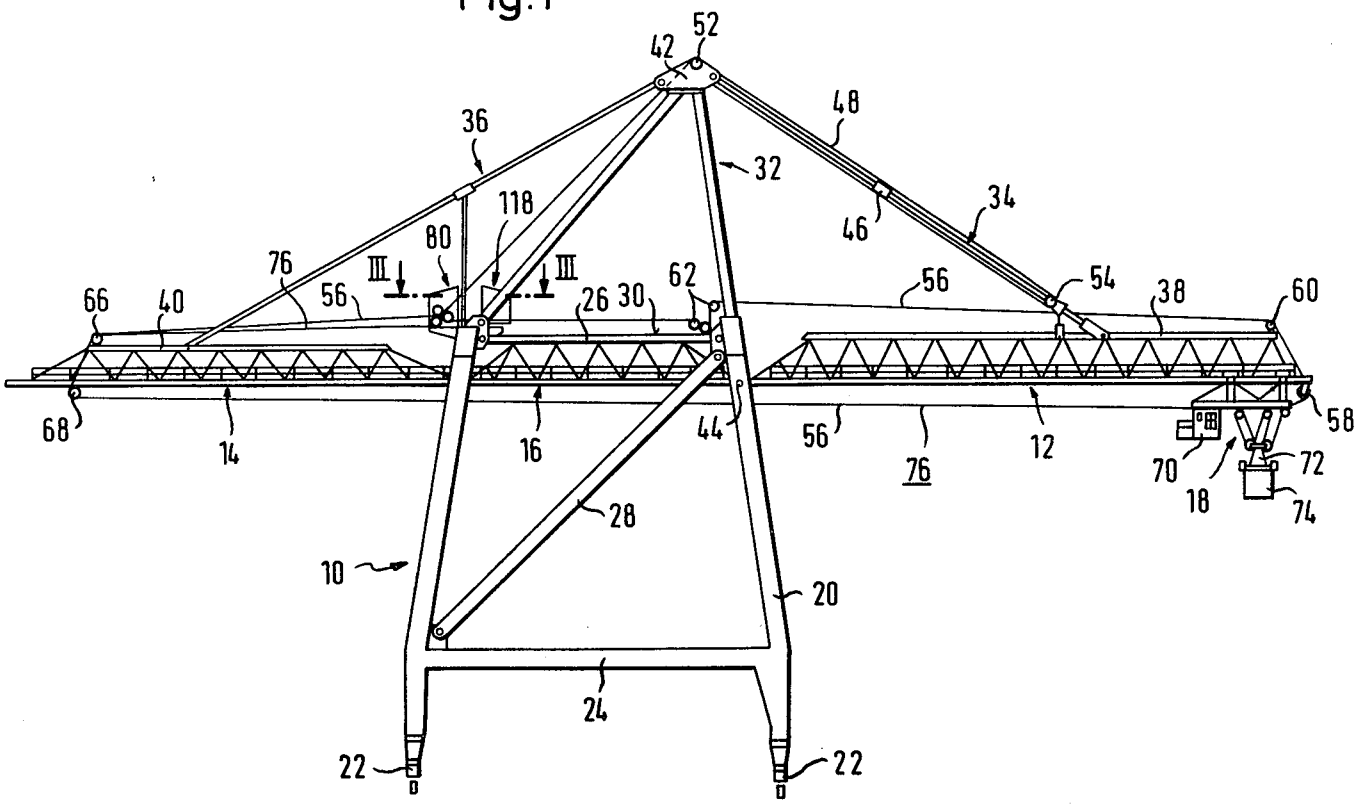
FIG. 1 shows a transporter crane of the invention in side elevation.

Referring now to the drawing in detail, and initially to FIG. 1, there is seen a transporter crane of the type commonly employed at dockside for loading and unloading container ships. The crane has a skeleton tower 10, a boom 12 pivotally fastened to the top of the tower 10, and a rear beam horizontally aligned with the boom 12 in the illustrated normal position of the crane. The boom 12, the beam 14, and a horizontally aligned girder 16 of the tower 10 carry a continuous track (not shown) for a trolley 18.

Figure 2:
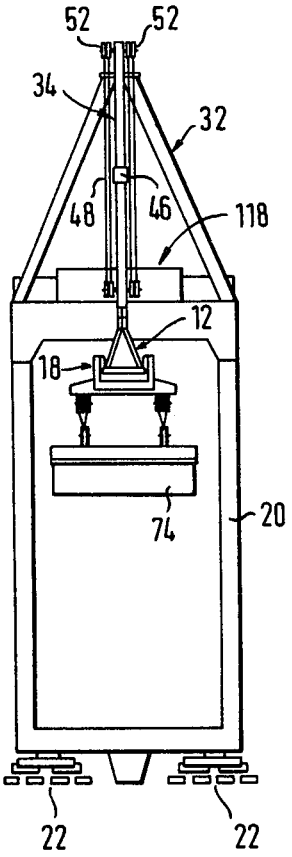
FIG. 2 is a front-elevational view of the crane.

As is better seen in FIG. 2, the tower includes two upright, rectangular frames 20 supported on respective undercarriages 22 whose wheels normally travel on rails, not shown. The frames 20 are rigidly connected by transverse connecting bars 24, 26 and reinforced by diagonal braces 28. The top of the tower 10 carries a platform 30 from which a head frame 32 extends upward.

The boom 12 and the beam 14 are normally held horizontal by tension rods 34, 36 attached to the upper chords 38, 40 of the boom and beam and to the uppermost part 42 of the head frame 32. The rods 36 are rigid and permanently maintain the horizontal position of the beam 14. The rods 34 each have two longitudinal sections connected by a hinge 46 so that they may be folded when the boom 12 is raised to clear the superstructure of ships at the dockside. The boom 12 may be raised and lowered on a pivot 44 by steel cables 48 that are trained from a winch housing 80 over pulleys 52 at the head frame part 42, pulleys 54 on the boom 12 near the fastened ends of the rods 34, and to a fastener, not shown in detail, at the head frame part 42.

The trolley 18 travels on rails, not shown, along the boom 12, the girder 16, and the beam 14. It may be moved by means of cable 56 whose two ends are fastened to the trolley, and are trained in a loop over pulleys 58, 60 at the free end of the boom 12, pulleys 62 on the crane tower 10, through the winch housing 80, and pulleys 66, 68 at the free end of the boom 14.

The trolley 18 carries the operator's cab 70 and a load carrier bar 72 from which a transporting container 74 is suspended as a load. The carrier 72 may be raised or lowered by means of hoisting cables 76 which are trained over pulleys coaxial with the afore-mentioned pulleys 66, 68 at the free end of the boom 14 to the winch housing 80.

Figure 3:
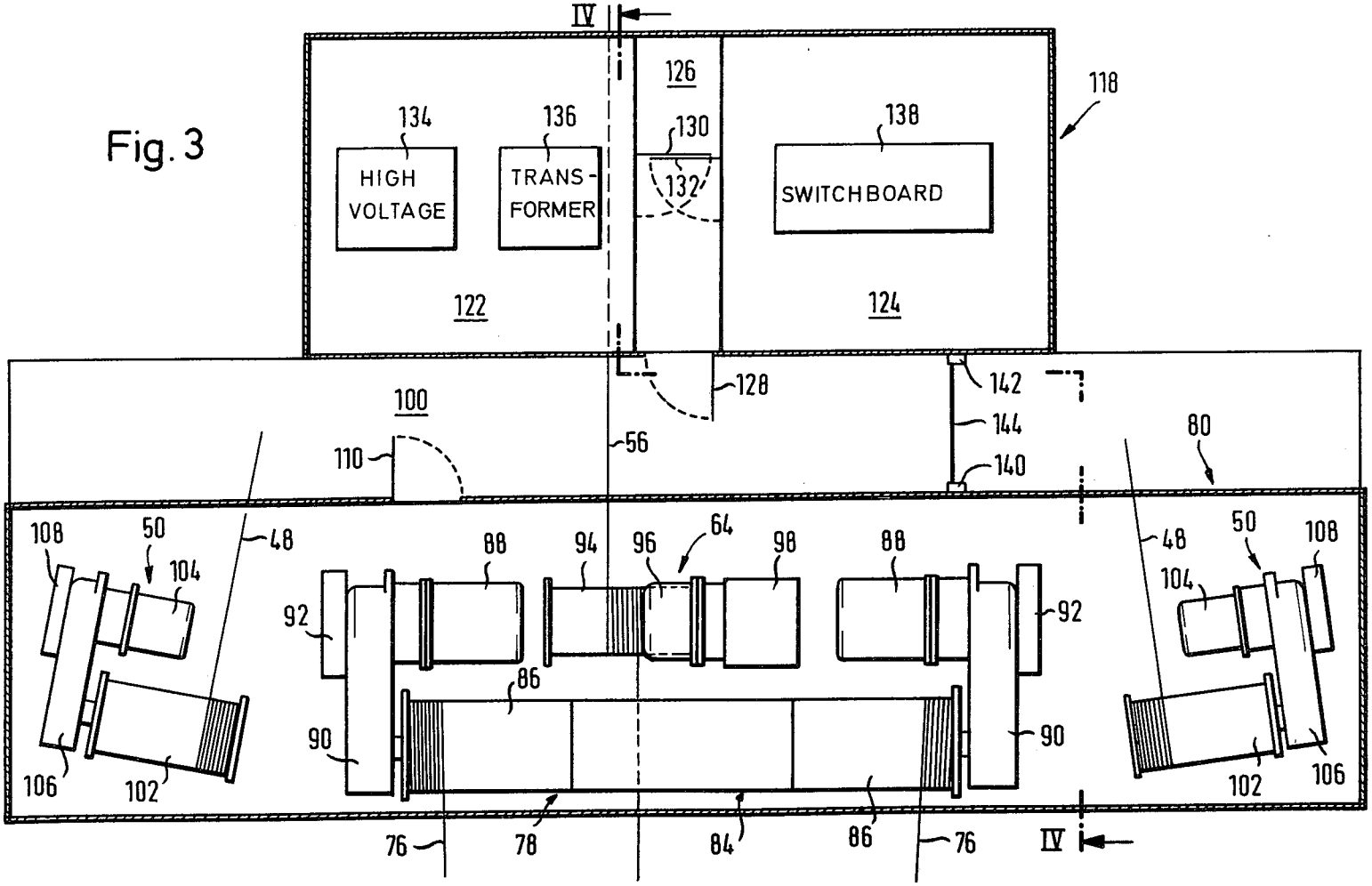
FIG. 3 shows a portion of the apparatus of FIG. 1 in enlarged section on the line III — III.
Figure 4:
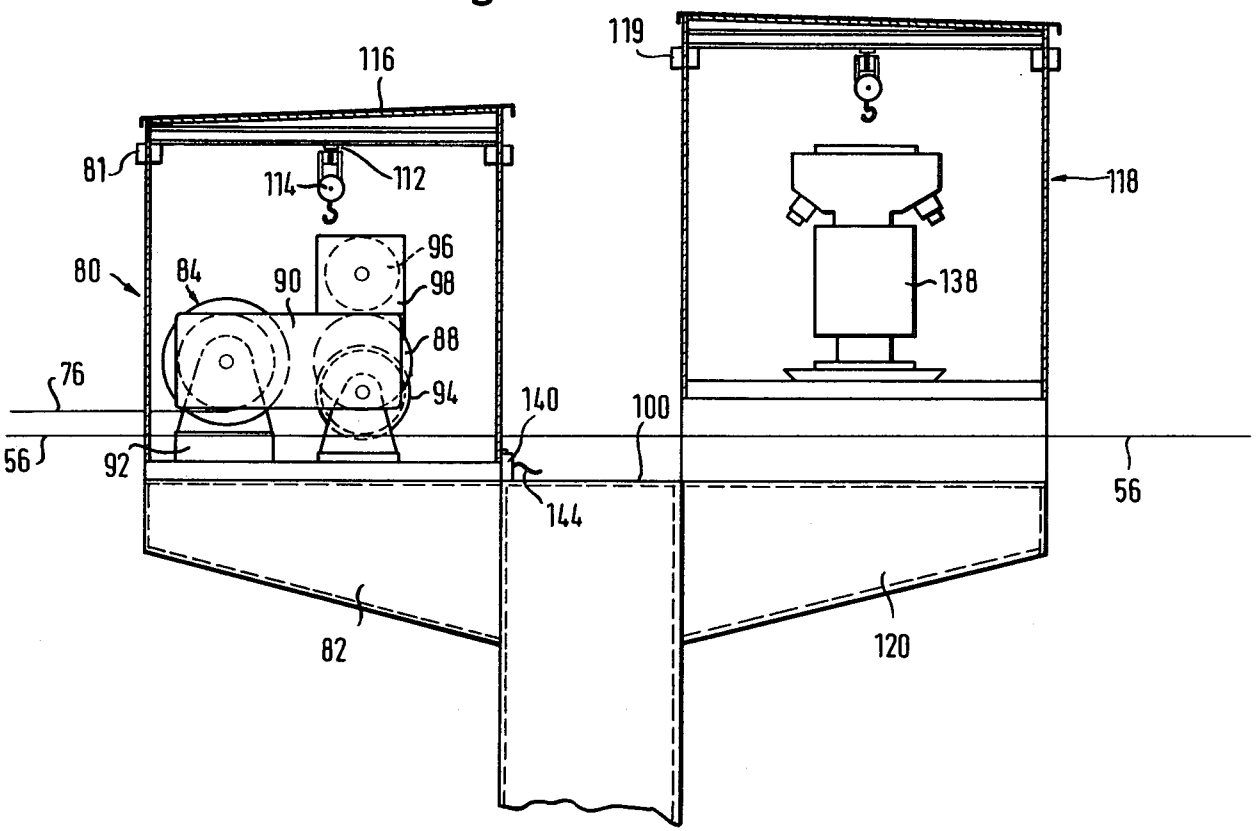
FIG. 4 shows the device of FIG. 3 and associated elements in section on the line IV — IV.

As is shown in more detail in FIGS. 3 and 4, the housing 80 is a transporting container of normal ISO dimensions and provided with standard ISO corner fittings 81. It is mounted on a heavy bracket 82 between the frames 20 on the approximate level of the platform 30, and is elongated transversely to the direction of trolley travel at the rear of the tower 10 remote from the boom 12.

The hoisting winch 78 is longitudinally centered in the container 80. It includes a cable drum 84 whose axially terminal parts 86 carry groups of windings of the cables 76. The drum 84 is driven by two heavy electric motors 88 through speed-reducing gear transmissions 90, the motors and transmissions being mounted on pedestals 92 fixedly fastened to a suitably reinforced floor of the container 80. The cables 76 pass outward of the container 80 toward the free end of the beam 14 through non-illustrated openings.

The winch 64 which moves the trolley 18 in its path is arranged between the motors 88 in the transverse plane of symmetry of the container 80 and of its contents. It includes a cable drum 94 driven by an electric motor 96 through a transmission 98. Non-illustrated pedestals attach the motor, transmission, and cable drum 94 to the bottom of the container 80. The two ends of the cable 56 pass outward of the container 80 toward the ends of the boom 12 and of the beam 14 in opposite directions.

Two winches 50 are arranged in the two longitudinal ends of the container 80. Each has a cable drum 102, an electric motor 104, a gear transmission 106, and necessary pedestals 108. The two cables 48 respectively wound on the drums 102 converge toward the center of the head frame part 42, and the axes of the drums 102 are inclined relative to each other to ensure a tangential relationship between the drum surfaces and the cables 46.

The electric motors, speed-reducing transmissions, and cable drums are permanently mounted in the container 80 in their illustrated respective positions by means of pedestals at the plant of the winch manufacturer, and may actually carry the associated steel cables when transported in the container to the assembly site for the crane. Because they are fixedly fastened to the container, they cannot damage each other during any mishap in transit that cannot destroy the container. The container and its content may be stored at the assembly site until the tower 10 is ready to receive the winches and their housing. When the container is fastened to the bracket 82, only the cables need be attached to the respective operating elements of the crane, and power supplied to the motors of the winches. Only an insignificant portion of the total construction time for the crane is spent at the assembly site for mounting the winches in their operating positions.

A door 110 in one of the longitudinal walls of the container 80 is secured in the closed position during transportation and hoisting of the container, and gives access to its interior for inspection and maintenance of the winch units. As is seen in FIG. 4, a rail 112 along the top wall of the container 80 supports a traveling hoist 114 and is installed simultaneously with the winch units. A roof 116 sloping toward one side of the container may be installed last to deflect rain water. If so desired, the top wall of the container may be raised on one side for the same purpose, and the resulting gaps between the top and side walls sealed by prepared wedges and strips. During transportation, the container 80 has the shape of a rectangular prism which facilitates handling.

The power supply system for the winches is installed in another container 118 as a permanent housing. The contents of the container 118 are assembled and installed at the electrical manufacturer's plant and protected by the container 118 during shipment and installation. The container 118 is mounted on a bracket 120 on the approximate level of the platform 30 and elongated transversely to the direction of trolley travel. The brackets 82, 120 are connected by a bridge 100. The container 118 is offset relative to the container 80 in an upward direction to clear the trolley driving cable 56. Both containers are installed on the tower 10 as far from the boom 12 as possible to serve as counterweights.

The container 118 has two compartments 122, 124 separated by a narrow aisle 126. A door 128 in the outer container wall leads into the aisle 126 from which the compartments may be entered through doors 130, 132.

The compartment 122 houses high-voltage equipment in a cabinet 134 and a step-down transformer 136. The compartment 124 encloses a switchboard 138 carrying switches for the winch motors which are remotely controlled from the cab 70 by the crane operator. The connections between the cabinet 134 and an external high-voltage line have not been shown and are conventional. All winch energizing circuits in the container 80 terminate in a socket 140 on an outer wall of the container 80, and the corresponding circuit parts in the container 118 terminate in a socket 142 on the wall of the container 118 opposite the socket 140 in the installed condition of the containers. The sockets are installed and wired in the respective manufacturers' plants. After installation of the containers, plugs at the ends of a short, multi-conductor cable 144 are inserted into the sockets 140, 142 to complete installation of the winches and of their electrical power supply system. The individual conductors linking the sockets 140, 142 to the winch motors and to respective relays on the switchboard 138 have not been illustrated, but will be obvious.

As is evident from joint consideration of FIGS. 3 and 4, the containers 80, 118 are equal in height, in width and differ in length only. A similar relationship between more than two containers can be maintained if the electrical equipment or the winches are not all installed in a common housing.

It should be understood, of course, that the foregoing disclosure relates only to a preferred embodiment of the invention, and that it is intended to cover all changes and modifications of the example of the invention chosen for the purpose of the disclosure which do not constitute departures from the spirit and scope of the invention set forth in the appended claims.

What is claimed is:

1. In a method of building a crane in which an upright tower is erected at an assembly site, a boom is pivotally fastened to the top portion of the tower, a trolley is installed for movement along the boom, a hoist is suspended from the trolley, a plurality of electrically actuated winches are secured to said tower and connected to said boom, said trolley, and said hoist by tension elements, said boom, trolley and hoist constituting the principal operating elements of said crane, an electric power supply system is mounted on said tower and conductively connected to said winches, the improvement which comprises:

a. fixedly mounting at least two of said winches in a first container at a construction site remote from said assembly site;

b. transporting said container to said assembly site;

c. fastening said container to the erected tower, the fixed mounting of said at least two winches in said container being maintained during said transporting and said fastening;

d. operatively connecting said at least two winches while mounted in said container to at least one of said principal operating elements by means of respective tension elements;

e. fixedly mounting at least a portion of said power supply system in a second container at a mounting site remote from said assembly site;

f. transporting said second container to said assembly site;

g. fastening said second container to the erected tower, the fixed mounting of said portion being maintained during said transporting and said fastening of said second container; and h. conductively connecting said portion of said power supply system, while mounted in said second container, to said at least two winches fixedly mounted in said first container while said containers are fastened to said tower.

2. In a method as set forth in claim 1, said portion of said power supply system being connected to said at least two winches by means of a single multiple conductor cable.

3. In a method as set forth in claim 2, mounting one part of a releasable, multiple-contact, two-part electrical coupling on the outside of one of said housings while remote from said assembly site, and mounting the other part of said coupling on said cable, said portion of said power supply system being connected to said at least two winches by engaging said parts of said coupling with each other.

4. In a method as set forth in claim 1, said containers satisfying the dimensional standards of the ISO and being equipped with corner fittings satisfying said standards, said containers being moved to a position contiguously adjacent said tower immediately prior to said fastening thereof by container handling equipment engaging said corner fittings.

5. In a method as set forth in claim 1, said portion of the power supply system including a step-down transformer.

6. In a method as set forth in claim 1, said at least two winches including three winches, said three winches being operatively connected after said fastening of said first container to respective operating elements by said tension elements, said portion of said power supply including a transformer and switch gear conductively connected to said transformer for receiving current therefrom, said switch gear being connected conductively to said three winches after said fastening of said second container.

* * * * *